United States Patent [19]

Sargeant et al.

[11] Patent Number: 4,813,396

[45] Date of Patent: Mar. 21, 1989

[54] METHODS AND APPARATUS FOR CHANGING LIQUID TEMPERATURE

[75] Inventors: Jack W. Sargeant, East Greenwich, R.I.; William F. Raleigh, Newhall; Attilio G. Giordani, Panorama City, both of Calif.

[73] Assignee: Teledyne Industries, Inc., Los Angeles, Calif.

[21] Appl. No.: 909,696

[22] Filed: Sep. 22, 1986

[51] Int. Cl.[4] ..... F24H 1/16

[52] U.S. Cl. ..... 126/391; 126/366; 126/368; 126/350 R; 126/351; 431/328; 431/7; 431/12; 4/493; 4/544; 165/40; 237/8 R; 237/56; 237/59; 138/45; 138/46

[58] Field of Search ..... 431/7, 328, 329, 347, 431/12; 126/391, 390, 366, 368, 416, 356 R, 351; 122/16, 17, 18, 158, 13 A, , 367 R, 367 A, 367 C; 4/493, 509, 545, 544, 543, 542, 541; 237/8 R, 56, 59; 165/40; 138/45, 46

[56] References Cited

U.S. PATENT DOCUMENTS

| | | | |
|---|---|---|---|
| 1,273,284 | 7/1918 | Smith | 431/347 X |
| 2,163,199 | 6/1939 | Hart | 431/347 X |
| 3,299,881 | 1/1967 | Koch | 126/416 X |
| 3,425,675 | 2/1969 | Twine | 431/328 X |
| 4,222,350 | 9/1980 | Pompei et al. | 122/367 C X |
| 4,381,031 | 4/1983 | Whitaker et al. | 165/39 |
| 4,392,610 | 7/1983 | Moskal | 237/55 |
| 4,403,572 | 9/1983 | Gerstmann et al. | 165/921 X |
| 4,406,278 | 9/1983 | Demmer | 126/416 |
| 4,480,488 | 11/1984 | Okabayashi et al. | 431/329 |
| 4,499,840 | 2/1985 | Meulenbrug | 431/328 X |
| 4,529,033 | 7/1985 | Blum | 4/493 |
| 4,609,014 | 9/1986 | Jurjevic et al. | 138/45 |
| 4,660,545 | 4/1987 | Ely | 4/493 |

FOREIGN PATENT DOCUMENTS

| | | | |
|---|---|---|---|
| 2253493 | 5/1973 | Fed. Rep. of Germany | 122/367 X |

OTHER PUBLICATIONS

Catalog #6014 by Raypak, Inc., "Model 33 Gas Fired Outdoor Spa Heater", 5/15/85.

"Out of Sight, Out of Mind," by Rinnai America Corporation.

FIG. 1 of Water Heater by Chaudière, Integralgas Paquet Thermique.

Brochure, "Power-Fin Gas Water Heaters," by Lochinvar Water Heater Corporation.

"Technology Profile Gas-Fired Fiber Matrix Burner", Gas Research Institute, Feb. 1984.

Brochure, "Catalyte 96 by MTD", by Catalyte Energy Systems.

*Primary Examiner*—Samuel Scott

*Assistant Examiner*—Carl D. Price

*Attorney, Agent, or Firm*—Benoit Law Corporation

[57] ABSTRACT

Water heating methods and apparatus feed a combustible mixture of gas and air to an axial inlet of a cylindrical radiant surface burner and conduct water to be heated through a heat exchanger encompassing that cylindrical radiant surface burner as a cylindrical structure having first passages for combustion gases therethrough substantially radially of the cylindrical radiant surface burner and the heat exchanger. Methods and apparatus for changing the temperature in a mass of liquid circulate that mass of liquid by pumping the liquid in a path extending from that mass of liquid back to that mass of liquid, provide a bypass for part of the pumped liquid from a downstream portion of the path to an upstream portion of that path, provide and maintain a constant liquid flow for the part of the pumped liquid in the bypass, change the temperature of the part of the pumped liquid at the constant liquid flow in the bypass, and change the temperature in the mass by mixing at the upstream portion the part of the pumped liquid of changed temperature from the bypass with liquid pumped in the path.

45 Claims, 2 Drawing Sheets

METHODS AND APPARATUS FOR CHANGING LIQUID TEMPERATURE

BACKGROUND OF THE INVENTION

Field of the Invention

The subject invention relates to methods and apparatus for changing the temperature of a liquid, to gas-fired water heaters, and to spa and hot tub sytems.

Information Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

A conventional approach to water heating is, for instance, apparent from Catalog No. 6014, by Raypak, Inc., entitled "Model 33 Gas Fired Outdoor Spa Heater." That heater is intended primarily to be built into the skirt of a spa or housing of spa equipment, and has a double impeller blower for combustion products and air, respectively, to achieve a cooler net output.

An underskirt portable spa gas heater is also apparent from a brochure entitled "Out of Sight, Out of Mind," by Rinnai America Corporation showing a burner assembly of the type apparent from the above mentioned Raypak catalog.

A water heater by Chaudière INTEGRALGAZ PAQUET THERMIQUE has a cylindrical heat exchanger structure the upper part of which encompasses a cylindrical gas burner. That upper part and a lower part of the heat exchanger of equal height are separated from each other by a horizontal wall extending below the cylindrical burner. There is an outer housing, as well as an inner housing located circumferentially at a distance from the outer housing and containing the burner and heat exchanger assembly. Air for combustion and cooling is blown in from the top by a blower mounted in an upper chamber of the outer housing.

A similar principle is apparent from a brochure entitled "Power-Fin Gas Water Heaters," by Lochinvar Water Heater Corporation, except that the full circle type power burner extends over most of the length of the cylindrical heat exchanger structure. The housing of the burner and heat exchanger assembly is encompassed and topped by a sealed and pressurized outer chamber contained a separate outer housing. A power fan located in a top portion of the outer chamber draws air from an intake around the combustion product vent near the bottom of the outer housing upwardly through the front portion of the outer chamber and applies that air to the outer chamber for a cool jacket and to the top inlet of the vertical burner for combustion.

A technological breakthrough in the gas burner area is apparent from the Gas Research Institute publication of February 1984, entitled "TECHNOLOGY PROFILE Gas-Fired Fiber Matrix Burner," showing and describing that kind of cylindrical radiant surface burner by Alzeta Corporation.

A similar burner achieving combustion on its outer surface is apparent from a brochure by CATALYTE ENERGY SYSTEMS entitled "Catalyte 96 by MTD." That water heating system also has an inner housing containing the cylindrical radiant surface burner and its encompassing helical heat exchanger, and an outer housing providing a cooling jacket about the inner housing and containing a gas/air pump, a water circulator pump, the electronic ignition and some controls. The air and gas mixture is pumped directly into the center of the cylindrical burner and also propels the departure of combustion products through an exhaust tube. That basic hydronic system may be built into a forced air system in which the heat exchanger of the burner is connected in series with a further heat exchanger, through which air is blown by a separate blower. Water heated by the burner and circulated through the two heat exchangers may thus be employed to heat air in a space heating system.

Despite these extensive efforts, the need for a smaller gas-fired water heater for spas and other applications where space is at a premium, has persisted.

Moreover, prior-art heaters are piped in series with the main flow system of the spa and thereby absorb considerable pumping power.

Prior-art systems sometimes use an auxiliary manual bypass valve to take up excessive water flow relative to a heater, as may be seen from the above mentioned brochure by Rinnai America Corporation.

Rinnai Corporation also put out a service manual for their Model REU-95GS-2 Gas Instantaneous Water Heater, showing a bypass for temperature control purposes. That bypass extends from a temperature control valve in an upstream portion of the conduit leading to the heat exchanger to a downstream portion or hot water outlet. By using the temperature control valve to vary the volume of water flowing through the bypass, the temperature of the water flowing from the heater and bypass assembly can be varied.

In an effort to adapt that system to use for spa heating purposes, a pump and filter combination was provided in a conduit extending from one portion of the spa to another portion of the spa, and the heater assembly, including the above mentioned bypass, was in effect located in a reverse bypass to that pump and filter assembly.

However, that system was discontinued in favor of a conventional spa heater type of approach.

SUMMARY OF THE INVENTION

It is a general object of this invention to overcome the disadvantages and to meet the needs expressed or implicit in the above Information Disclosure Statement and in other parts hereof.

It is a germane object of this invention to provide improved gas-fired water heaters.

It is a specific objection of this invention to reduce the size of gas-fired water heaters relative to their attainable performance.

It is a related object of the invention to provide improved methods of heating water.

It is also an object of this invention to provide improved methods and apparatus for changing the temperature in a mass of liquid.

It is a related object of this invention to save energy and reduce required pumping power in heating or cooling a pool or mass of liquid pumped from and back to the pool or mass.

From a first aspect thereof, the subject invention resides in a gas-fired water heater comprising means for providing a combustible mixture of gas and air at an outlet thereof, a cylindrical radiant surface burner having an inlet extending along a longitudinal axis of the cylindrical burner and being connected to that outlet for receiving the combustible mixture of gas and air, and having on the longitudinal axis an end opposite to that inlet, means for conducting water to be heated past the burner, said means for conducting water including a heat exchanger encompassing that cylindrical radiant surface burner in the form of a cylindrical structure having first passages for passing combustion gases substantially radially of the cylindrical radiant surface burner and the heat exchanger, a parallelepipedal housing enclosing the cylindrical radiant surface burner and the cylindrical structure of the heat exchanger and having a plurality of spaced corners projecting radially away from the cylindrical structure, means for providing through the corners second passages for combustion gases extending along the heat exchanger substantially in series to the first passages, means for igniting the combustible mixture in that housing, a refractory end piece in that housing adjacent the end of the cylindrical radiant surface burner, a plurality of exhaust apertures defined by that refractory end piece and the plurality of corners, and means connected to these exhaust apertures for exhausting combustion gases from the cylindrical radiant surface burner through the above mentioned first and second passages into and along the housing corners and into and through the exhaust apertures to the outside of the housing. The above mentioned corners are formed at right angles to sides of the parallelepipedal housing and extend from one end to an opposite end of that housing.

From a related aspect thereof, the subject invention resides in a method of heating water, comprising in combination the steps of providing a combustible mixture of gas and air at one end of the housing, feeding said combustible mixture of gas and air from that one end of the housing to an inlet of a cylindrical radiant surface burner having an end opposite to that inlet, conducting water to be heated past the burner through a heat exchanger encompassing that cylindrical radiant surface burner in the form of a cylindrical structure having first passages for passing combustion gases substantially radially of the cylindrical radiant surface burner and the heat exchanger, providing a parallellepipedal housing enclosing the cylindrical radiant surface burner and the cylindrical structure of the heat exchanger providing said parallelepipedal with a plurality of housing spaced corners projecting radially away from that cylindrical structure, said corners providing second passages for combustion gases extending along the heat exchanger substantially in series to the first passages, providing means for igniting the combustible mixture in the housing providing a refractory end piece in the housing adjacent the end of the cylindrical radiant surface burner, defining a plurality of exhaust apertures with the refractory end piece and the plurality of, and exhausting combustion gases from the cylindrical radiant surface burner at an end of the housing opposite to that one end of the housing through the first and second passages into and along the housing corners and into and through the exhaust apertures to the outside of the housing.

The above mentioned corners are formed at right angles to sides of the parallelepipedal housing and extend from one end to an opposite end of that housing.

From another aspect thereof, the invention resides in apparatus for changing the temperature in a mass of liquid, comprising, in combination, a path for that liquid having an upstream portion connected to that mass and a downstream portion connected to this mass at a distance from that upstream portion, means in that path between the upstream and downstream portions for circulating the mass of liquid by pumping the liquid in that path, a bypass for part of the pumped liquid extending from the downstream portion to the upstream portion of that path, means in that bypass for providing and maintaining a constant liquid flow for the part of the pumped liquid in the bypass during pumping, a gas-fired heater in that bypass for heating said part of the pumped liquid at the constant liquid flow in the bypass, and means at the upstream portion for mixing the part of the pumped liquid of changed temperature with liquid pumped in the above mentioned path whereby to change the temperature in the mass of liquid.

From a related aspect thereof, the invention resides in a method for changing the temperature in a mass of liquid with a gas-fired heater, comprising in combination the steps of circulating that mass of liquid by pumping the liquid in a path extending from that mass of liquid back to that mass of liquid, providing a bypass for part of the pumped liquid from a downstream portion of that path to an upstream portion of that path, providing and maintaining a constant liquid flow for the part of the pumped liquid in that bypass during pumping, changing the temperature of that part of the pumped liquid by heating said part of the pumped liquid with said gas-fired water heater at the constant liquid flow in the bypass, and changing the temperature in the mass of liquid by mixing, at the upstream portion, the above mentioned part of the pumped liquid of changed temperature from the bypass with liquid pumped in the above mentioned path.

BRIEF DESCRIPTION OF THE DRAWINGS

The subject invention and its objects and aspects will become more readily apparent from the following detailed description of preferred embodiments thereof, illustrated by way of example in the accompanying drawings, in which like reference numerals designate like and functionally equivalent parts, and in which.

DESCRIPTION OF PREFERRED EMBODIMENTS

Figure 1:
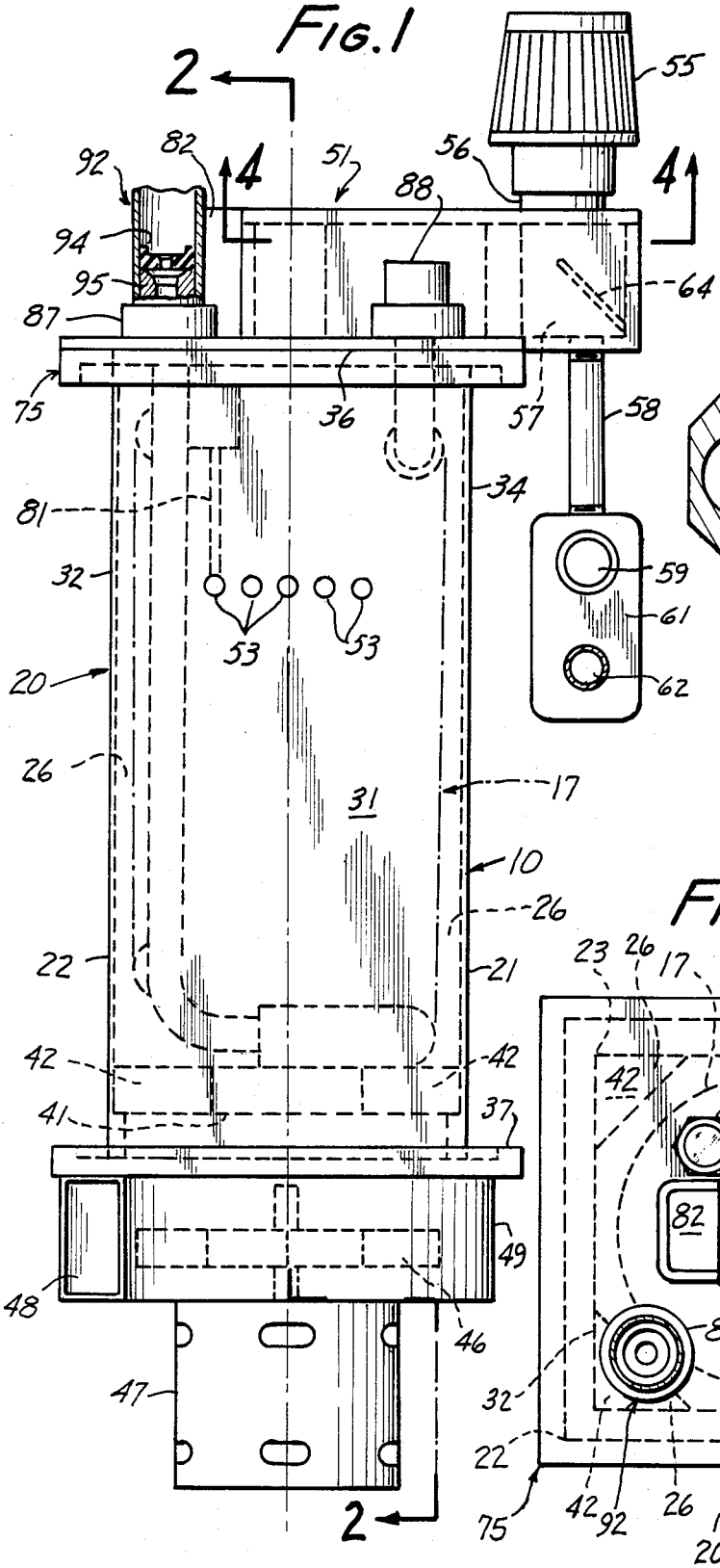
FIG. 1 is an elevation of a gas-fired water heater according to a preferred embodiment of the subject invention.
Figure 4:
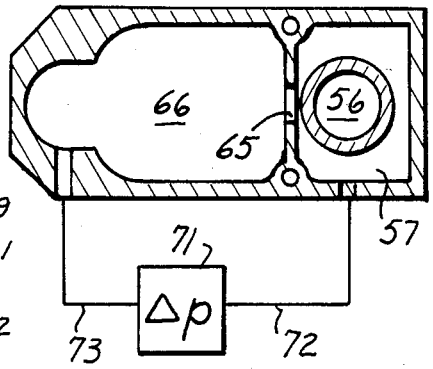
FIG. 4 is a section taken on the line 4—4 in FIG. 1.
Figure 2:
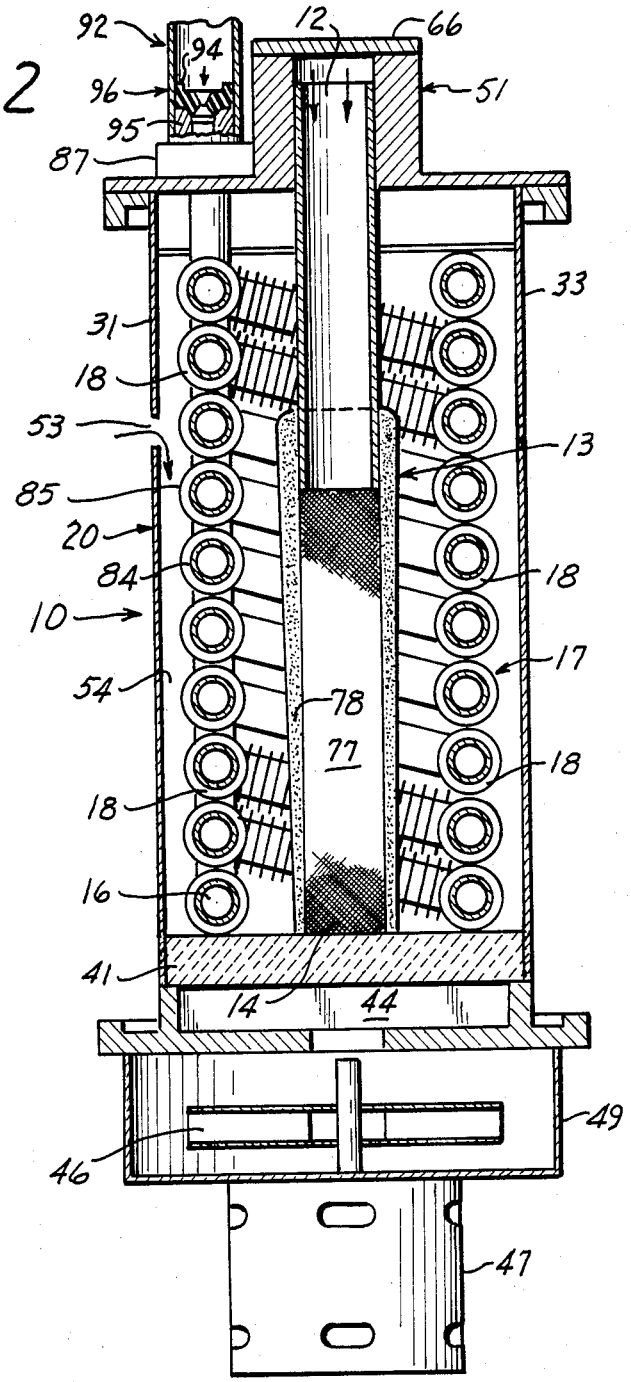
FIG. 2 is a view, partially in section, taken on the line 2—2 in FIG. 1.

The gas-fired water heater 10 shown in FIGS. 1 and 2 feeds a combustible mixture of gas and air to an axial inlet 12 of a cylindrical radiant surface burner 13 having an end 14 axially opposite to that inlet. That water heater also conducts water 16 to be heated past the burner through a heat exchanger 17 encompassing the cylindrical radiant surface burner 13 as a cylindrical structure having first passages 18 for combustion gases therethrough substantially radially of that cylindrical radiant surface burner and the heat exchanger 17.

According to the subject invention, the water heater 10 has a housing 20 enclosing the cylindrical radiant surface burner 13 and the cylindrical structure of the heat exchanger 17 with a plurality of corners 21, 22, 23 and 24 projecting radially away from that cylindrical structure, being spaced from each other and providing second passages 26 for combustion gases extending along the heat exchanger 17 substantially in series to the first passages 18.

In this manner, each heater unit can be provided at a smaller profile, since the housing walls 31, 32, 33 and 34, between the housing corners 21 to 24, can extend closer to the cylindrical heat exchanger 17, than if the housing were cylindrical, whereby the corner exhaust passages 26 would not be present.

Also, a cornered housing is generally easier to manufacture. This is particularly the case when the corners 21 to 24 are shaped as rectangular corners of a parallelelepipedal housing extending from one end 36 to the opposite end 37 of the housing structure. This also provides the housing with a low profile in side view, which is important for spa heater and other applications where space is at a minimum, and with generous exhaust channels 26 along four sides of the cylindrical structure of the heat exchanger 17.

A refractory end piece 41 is provided in the housing 20 adjacent the lower end 14 of the cylindrical radiant surface burner 13.

A plurality of exhaust apertures 42 are provided adjacent the refractory end piece 41 and the plurality of corners 21 to 24. In the illustrated preferred embodiment of the invention, the exhaust apertures are formed by cutting corners off the refractory end piece 41 or by otherwise slanting or recessing that end piece from the housing corners 21 to 24. By way of example, where the housing 20 has a square cross-section, the end piece may be octagonal and fitted inside that housing.

The exhaust apertures 42 are extensions of the exhaust channels 26 into an exhaust chamber 44. Combustion gases are exhausted from the cylindrical radiant surface burner 13 through the first and second passages 18 and 26 into and along the corners 21 to 24 and into and through the exhaust apertures 42 to the outside of the housing structure.

By way of example, a radial fan 46 driven by an electric motor 47 is provided at the lower end of the housing structure for exhausting combustion gases through an exhaust opening 48 in a fan housing 49.

According to the illustrated preferred embodiment of the invention, an assembly 51 for providing the combustible mixture of gas and air is located at one end 36 of the housing, and the means 47 to 49 for exhausting combustion gases are located at the opposite end 37 of the housing structure. This greatly increases the efficiency of the heating process and heating unit, while at the same time minimizing its overall profile and providing for a rather easy and inexpensive manufacture of the unit.

It is a particular feature of the illustrated preferred embodiment, that the housing 20 is the only housing that need to be provided for the heater unit. This stands in favorable contrast to prior-art heating assemblies which needed a separate housing to provide a cooling space or jacket around an enclosure of the burner and heat exchanger assembly.

By admitting the combustible mixture of gas and air at one end 36 of the housing while exhausting combustion gases at the other housing end 37, the illustrated preferred embodiment of the subject invention also enables admission of dilution air to the inside of the housing 20 for cooling purposes. For instance, dilution openings 53 may be provided in any one or more of the housing walls 31 to 34. Such dilution air mixes with the exhaust gases drawn through the clearance 54 between the housing wall 31 and the heat exchanger 17 by the exhaust fan 46.

In practice, this also makes for a cooler operation of the exhaust fan assembly 46 to 49, in addition to cooling the housing wall 31 and the stream of exhaust gases at 48. These are also important considerations in terms of avoiding injury to people and animals and damage to property.

According to the illustrated preferred embodiment of the invention, the dilution air openings 53 are located closer to the one end 36, where the combustible mixture of gas and air is admitted, than to the other end 37 of the housing, where combustion products and dilution air are exhausted.

Another significant advantage of the system according to the illustrated preferred embodiment of the invention is that while the assembly 51 for providing the combustible mixture of gas and air is located at one end 36 of the housing 20, the means for providing such combustible mixture actually includes the means or fan assembly 47 to 49 for exhausting combustion gases at the opposite end 37. In fact, such means 47 to 49 preferably constitute the only means for drawing the air for the mixture of gas and air at the one end 36 of the housing. This favorably distinguishes heater units according to the subject invention from prior-art approaches which had an upstream fan or compressor for injecting air into the unit or into the burner therein.

In the illustrated preferred embodiment, the assembly 51 for providing a combustible mixture of gas and air include an air filter 55 at the one end 36 of the housing, and include also the means 47 to 49 for exhausting combustion gases at the opposite end 37 of the housing as the only means for drawing air through the air filter 55 to provide the necessary mixture of gas and air at the one end 36 of the housing.

In this manner, and in general within the scope of the currently discussed aspect of the invention, the combustible mixture of gas and air is provided by drawing air for that mixture of gas and air at the one end 36 of the housing only by exhausting combustion gases at the opposite end 37 of that elongate housing 2..

Air drawn through the filter 55 proceeds through an air conduit 56 to the gas and air mixing chamber 57 of the assembly 51. Natural or other combustible gas enters that chamber 57 through a gas line 58. A conventional gas valve 59 with pressure regulator 61 may be employed for that purpose, and may be connected to a gas supply line 62.

The mixing assembly 51 not only directs fuel and air to the burner 13, but also enhances mixing of these gas and air components for improved combustion. According to the illustrated preferred embodiment of the invention, this is accomplished with a gas deflector plate 64 and a gas-air mixing orifice 65.

According to the illustrated preferred embodiment of the invention, the orifice structure 65 is provided at one end 36 of the housing, and gas and air is drawn through that orifice structure at that one end of the housing only by exhausting combustion gases at the opposite end 37 of that housing 20.

One purpose of the orifice structure 65 is to induce turbulence in mixing the gas and the air proceeding from the chamber 57 into a further chamber 66 connected to the inlet opening 12 of the burner 13. In practice, such induced turbulence makes for an ideal mixture of gas and air for combustion in the heater 10.

A related important feature of the orifice structure is to provide for a continuous proving of the gas and air mixture. This may, for instance, be done by sensing a pressure drop across or through the orifice 65 as an indication of combustion air and gas flow, with such pressure drop varying as a function of the square of the flow.

In practice, a conventional differential pressure sensing switch 71 may have first and second lines 72 and 73 connected to the chambers 57 and 66, respectively, for sensing flow as a function of differential pressure. By way of example, the pressure switch 71 may be tied in with the gas control 61, to regulate the gas flow. In this manner, the gas valve can, for instance, be shut off if the flow is too low for good combustion, as might occur when the air inlet or filter 55 is clogged, or is blocked by an object, such as a towel in the case of a spa heater. The same in essence applies when a towel or other obstruction blocks the exhaust opening 48 of the unit. Again, the preferred embodiment of the subject invention provides significant safety measures in this respect, preventing injury to people and damage to equipment and property.

Also in the illustrated preferred embodiment of the subject invention, the housing 20 has an end or top plate structure 75 for carrying the gas and air mixing assembly 51, and has the combustion gas or effluent exhaust fan assembly 47 to 49 at the opposite end 37 of the housing structure. In this respect, the assembly 51 preferably is located on the end plate structure 75 outside of the housing 20.

Figure 3:
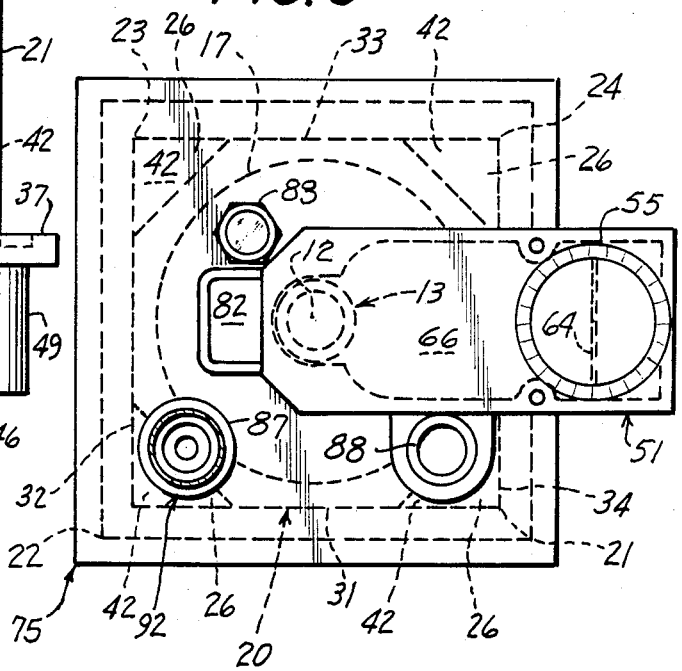
FIG. 3 is a top view of the heater shown in FIGS. 1 and 2.

In the case of the parallelepipedal housing 20 shown in FIGS. 1 to 3, the end plate structure 75 is square or rectangular, as seen in FIG. 3.

Also by way of preferred example, the above mentioned first end 36 is the top, while the above mentioned opposite or second end 37 is the bottom of the vertically arranged housing structure. In that case, the unit fires from top to bottom, with the fuel and air mixture being forced into the top end 12 of the vertically-oriented cylindrical burner 13. The combustible mixture is drawn radially outward through circumferentially distributed openings 77 in the burner 13. By way of preferred example, that burner is of the above mentioned fiber matrix type, having an outside peripherally covered by a fiber matrix 78.

Conventional ignition may be employed for igniting the combustible mixture in the housing 20. By way of example, a glow-type ignitor 81 may be provided in the housing, such as at or in the space between the burner 13 and heat exchanger 17. Conventional ignitor mounting 82 and flame-proving safety logic may be employed for that purpose. A view port 83 permits inspection of igniter and burner action through a glass disc.

The combustible gas and air mixture burns on the surface of the burner 13 or fiber matrix 78. This permits the unit to be very compact, since the heat exchanger 17 need only be spaced from the burner by about a centimeter or half an inch. That kind of burner has a low pressure drop and very good emission characteristics, including low NOX, carbon monoxide and unburned hydrocarbon effluents.

Heat exchangers of different types, shapes and form may be employed at 17. However, by way of preferred example, the cylindrical structure of the heater exchanger 17 is in the form of a helically coiled heat exchanger tube 84 having fins 85 and having the radial combustion gas exhaust passages 18 between turns thereof.

The heat exchanger 17 has a water inlet 87 and a water outlet 88. In the illustrated preferred embodiment, both such inlet 87 and outlet 88 are located at the same end of the housing, such as at the top end 36 and top plate structure 75. In practice, this facilitates the operation and also the servicing of the unit which, for instance, may be slid out of a cabinet in which it is located, for servicing of the unit external to that cabinet or external to a spa assembly or structure 91.

The currently disclosed aspect of the invention provides means 92 in series with the heat exchanger 17 for providing and maintaining a constant liquid flow through that heat exchanger. In the embodiment illustrated in the drawings, these constant liquid flow control means 92 are located at the water inlet 87 in series therewith.

In the illustrated preferred embodiment of the invention, the means 92 for providing and maintaining the constant liquid flow include an elastic flow control having an elastic annulus 94 and a seat for that annulus defining a conical seat extension 95 for receiving part of that elastic annulus in response to pressure increases in the liquid flow, as illustrated at 96 in FIG. 2, so as to maintain the liquid flow through the heat exchanger 17 essentially constant.

By way of preferred example, the constant flow control 92 may be of the kind manufactured by Vernay Laboratories Inc., Yellow Springs, Ohio 45387, and shown, for instance, in their April 1984 brochure entitled "Rubber Flow Controls," which also lists manufacturing and distribution subsidiaries.

The constant flow control 92 satisfies mutually conflicting requirements, by enabling the water flow through the heat exchanger 17 to be maintained sufficiently high so as to prevent deposition of lime and other contaminants in the heat exchanger tube 84, while at the same time maintaining such sufficiently high flow rates at values below those that would cause erosion of the heat exchanger at the inside thereof, and condensation at its outside. As is well known, erosion occurs from aggressive water qualities at excessive flow rates, while such high flow rates also tend to pull down the temperature of the surface of the tube 84 of the heat exchanger to a value below the dew point for condensation of water vapor in the combustion products.

Figure 5:
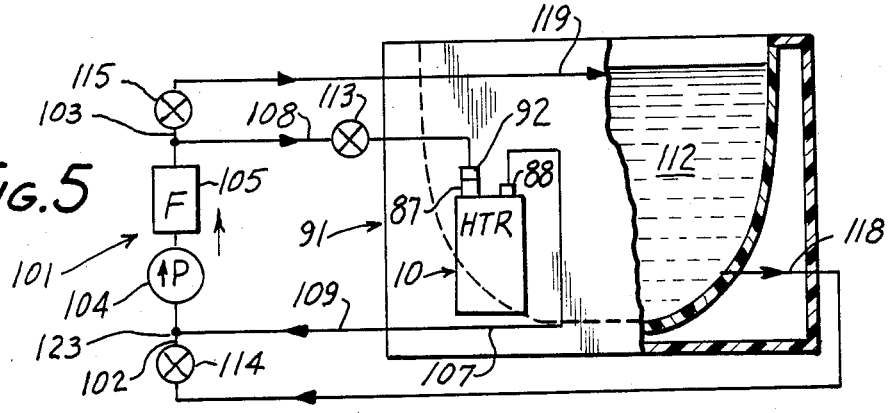
FIG. 5 is a diagramatic view of a spa installation according to a related further aspect of the invention.

The water heater according to a preferred embodiment of the subject invention may be employed for pumping water through a path 101 having an upstream portion 102 and a downstream portion 103. As shown in FIG. 5, a series connected combination of a pump 104 and a water filter 105 may be employed for that purpose. A bypass 107 for part of the pumped water extends from the downstream portion 103, such as via a line 108, to the upstream portion 102, such as by way of a pipe or line 109. The bypass 107 thus operates as a reverse bypass relative to the pump filter path 101, but as a forward bypass relative to water 112 in the spa 91. The filter 105 may alternatively be downstream of the point at 103, upstream of the point at 102, or omitted entirely.

According to this aspect of the invention, the heater 10 and the means 92 for maintaining constant liquid flow through the heat exchanger, are connected in series with the bypass 107. In this manner, the heater 10 is located in the bypass 107 for heating part of the pumped water with the cylindrical radiant surface burner 13. At the same time, the constant liquid flow control 92 maintains the flow of the water through the heat exchanger 17 at an essentially constant rate, irrespective of motivating pressure provided by the pumping system. In practice, this is very important in pool, spa, and other applications in which pump and filter equipment impose a wide range of hydraulic conditions.

In the embodiment illustrated in FIG. 5, the water heater inlet is connected via constant flow control 92 and line 108 to the downstream portion 103 of the pumped main path 101, while the water heater outlet 88 is connected via line 109 to the upstream portion 102 ahead of the pump 104. After water has passed through the heater 10, such heated water is mixed with the cooler upstream portion of the water entering the pump 104. That pump, in turn, needs to pump only sufficient water through the heater 10 to provide the desired water temperature at the downstream portion 103 for the pool 112. This saves considerable pumping power, which would otherwise have to be expended, if all the water flowing to the pool 112 were pumped through the heater.

Suitable thermostats or temperature-sensing devices may be employed in the main and bypass branches 101 and 107, as shown in FIG. 5 at 113, 114 and 115 for alternative locations, in order to control the heater and the water temperature.

The constant liquid flow control 92 may be located either at the inlet 87 or at the outlet 88, for instance.

In the embodiment shown in FIG. 5, the main path extends from the pool of water 112, as indicated by a line 118, back to a different portion of that pool, as indicated by a line 119, whereby the water heater elevates the temperature of that pool of water 112 in a controlled manner.

As indicated, the pool of water 112 may be contained in a spa installation 91, wherein the heater 10 is concealed in the skirt of the spa. Since only a fraction of the pumped liquid passes through the heater 10, flexible hoses may be employed to connect the water inlet and outlet 87 and 88 to the lines 108 and 109. The resulting flexibility simplifies service, in that the heater can be slid in and out of the tub enclosures without disconnection of water lines for that purpose. The input gas line 62 may also be flexible.

The principle shown in FIG. 5 or disclosed herein with reference thereto is generally applicable to methods and apparatus for changing the temperature in a mass of liquid. In that case also, a path 101 is provided for that liquid having an upstream portion 102 connected to the mass 112 and a downstream portion 103 connected to that mass at a distance from the upstream portion, as indicated by the spaced lines 118 and 119. A pump 104 or other means are located in that main path 101, for circulating the mass of liquid by pumping the liquid in that path. A bypass 107 for part of the pumped liquid extends from the downstream portion 103 to the upstream portion 102 of the path, and means 92 are in that bypass 107 for providing and maintaining a constant liquid flow for that part of the pumped liquid in the bypass during pumping.

Further means are provided in the bypass for changing the temperature of the part of the pumped liquid at the constant liquid flow in that bypass 107. A T-connection 123 or other means connected in the main path 101 and to the bypass 109 mix the part of the pumped liquid of changed temperature from the bypass 107 with liquid pumped in the path 101 whereby to change the temperature of the mass of liquid 112.

In principle, the means for changing the temperature in the bypass 107 may comprise the heater 10 or another heater or heating appliance. Conversely, refrigerative or other cooling means may be provided in the bypass 107, if cooling of the mass of liquid is desired. In that case, only part of the liquid from the mass 112 is pumped through a heat exchanger of a refrigerative unit in the bypass 109, and the resulting cooled liquid is then mixed at 123 with the main pumped liquid, for a cooling of the mass of liquid 112 to a desired temperature controlled by thermostats or thermostatically controlled valving at 113 and 114 or 115.

Pursuant to the principles of the currently discussed aspect of the subject invention, the constant flow control 92 or other means for maintaining constant liquid flow in the bypass 107 are again provided in that embodiment of the invention.

The subject extensive disclosure will render apparent or suggest to those skilled in the art various modifications and variations within the spirit and scope of the subject invention and equivalents thereof.

We claim:

1. A gas-fired water heater comprising in combination:

means for providing a combustible mixture of gas and air at an outlet thereof;

a cylindrical radiant surface burner having an inlet extending along a longitudinal axis of said cylindrical burner and being connected to said outlet for receiving said combustible mixture of gas and air, and having on said longitudinal axis an end opposite to said inlet;

means for conducting water to be heated past said burner, said means for conducting water including a heat exchanger encompassing said cylindrical radiant surface burner in the form of a cylindrical structure having first passages for passing combustion gases substantially radially of said cylindrical radiant surface burner and said heat exchanger;

a parallelepipedal housing enclosing said cylindrical radiant surface burner and said cylindrical structure of said heat exchanger and having a plurality of spaced corners projecting radially away from said cylindrical structure, said corners being formed at right angles to sides of said parallelepipedal housing, extending from one end to an opposite end of said housing and defining second passages for combustion gases extending along said heat exchanger substantially in series to said first passages;

means for igniting said combustible mixture in said housing;

a refractory end piece in said housing adjacent said end of the cylindrical radiant surface burner;

a plurality of exhaust apertures defined by said refractory end piece and said plurality of corners; and means connected to said exhaust apertures for exhausting combustion gases from said cylindrical radiant surface burner through said first and second passages into and along said corners and into and through said exhaust apertures to the outside of said housing.

2. A water heater as claimed in claim 1, wherein:
said means for providing a combustible mixture of gas and air are located at said one end of said housing; and
said means for exhausting combustion gases are located at said opposite end of the housing.

3. A water heater as claimed in claim 2, wherein:
said cylindrical structure is in the form of a helically coiled heat exchanger tube having said first passages between turns thereof.

4. A water heater as claimed in claim 3, wherein:
said means for conducting water include a water inlet and a water outlet for said heat exchanger; and
said water inlet and said water outlet are both located at the same end of said housing.

5. A water heater as claimed in claim 2, wherein:
said means for conducting water include a water inlet and a water outlet for said heat exchanger; and
said water inlet and said water outlet are both located at said one end of said housing.

6. A water heater as claimed in claim 2, wherein:
said means for providing a combustible mixture of gas and air include said means for exhausting combustion gases at said opposite end of the housing as the only means for drawing said air for said mixture of gas and air at said one end of the housing.

7. A water heater as claimed in claim 2, wherein:
said means for providing a combustible mixture of gas and air include an air filter at said one end of the housing, and include also said means for exhausting combustion gases at said opposite end of the housing as the only means for drawing air through said air filter to provide said mixture of gas and air at said one end of the housing.

8. A water heater as claimed in claim 2, wherein:
said means for providing a combustible mixture of gas and air include an orifice structure at said one end of the housing for mixing gas and air, and include also said means for exhausting combustion gases at said opposite end of the housing as the only means for drawing gas and air through said orifice structure at said one end of the housing.

9. A water heater as claimed in claim 8, wherein:
said orifice structure includes means for inducing turbulence in mixing said gas and air.

10. A water heater as claimed in claim 8, wherein:
said housing has dilution air openings for admitting dilution air to the inside thereof; and
said dilution air openings are located closer to said one end than to said opposite end.

11. A water heater as claimed in claim 2, wherein:
said parallelepipedal housing is the only enclosure of said cylindrical radiant surface burner and said heat exchanger.

12. A water heater as claimed in claim 11, wherein:
said parallelepipedal housing has an end plate at said one end supporting said means for providing a combustible mixture of gas and air; and
said means for exhausting combustion gases include a combustion gas exhaust fan at said opposite end of the housing.

13. A water heater as claimed in claim 12, wherein:
said means for providing a combustible mixture of gas and air are located on said end plate outside of said parallelepipedal housing.

14. A water heater as claimed in claim 1, wherein:
said cylindrical structure is in the form of a helically coiled heat exchanger tube having said first passages between turns thereof.

15. A water heater as claimed in claim 14, wherein:
said means for conducting water include a water inlet and a water outlet for said heat exchanger; and
said water inlet and said water outlet are both located at the same end of said housing.

16. A water heater as claimed in claim 1, wherein:
said means for conducting water include a water inlet and a water outlet for said heat exchanger; and
said water inlet and said water outlet are both located at said one end of said housing.

17. A water heater as claimed in claim 1, wherein:
said means for providing a combustible mixture of gas and air include an orifice structure for mixing gas and air, and include also said means for exhausting combustion gases for drawing gas and air through said orifice structure.

18. A water heater as claimed in claim 17, wherein:
said orifice structure includes means for inducing turbulence in mixing said gas and air.

19. A water, heater as claimed in claim 17, including:
means for sensing a pressure drop provided by said orifice structure.

20. A water heater as claimed in claim 17, wherein:
said housing has dilution air openings for admitting dilution air to the inside thereof.

21. A water heater as claimed in claim 1, wherein:
said parallelepipedal housing is the only enclosure of said cylindrical radiant surface burner and said heat exchanger.

22. A water heater as claimed in claim 1, wherein:
said exhaust apertures are defined by said refractory end piece inside of and along each of said corners.

23. A water heater as claimed in claim 1, including:
means in series with said heat exchanger for providing and maintaining a constant liquid flow through said heat exchanger.

24. A gas-fired water heater comprising in combination:
means for providing a combustible mixture of gas and air at an outlet thereof;
a cylindrical radiant surface burner having an inlet extending along a longitudinal axis of said cylindrical burner and being connected to said outlet for receiving said combustible mixture of gas and air, and having on said longitudinal axis an end opposite to said inlet;
means for conducting water to be heated past said burner, said means for conducting water including a heat exchanger encompassing said cylindrical radiant surface burner in the form of a cylindrical structure having first passages for passing combustion gases substantially radially of said cylindrical radiant surface burner and said heat exchanger;
a paralllelepipedal housing enclosing said cylindrical radiant surface burner and said cylindrical structure of said heat exchanger and having a plurality of spaced corners projecting radially away from said cylindrical structure and defining second passages for combustion gases extending along said heat exchanger substantially in series to said first passages;

means for igniting said combustible mixture in said housing;

a refractory end piece in said housing adjacent said end of the cylindrical radiant surface burner;

a plurality of exhaust apertures defined by said refractory end piece and said plurality of corners;

means connected to said exhaust apertures for exhausting combustion gases from said cylindrical radiant surface burner through said first and second passages into and along said corners and into and through said exhaust apertures to the outside of said housing;

means for pumping water through a path having an upstream portion and a downstream portion;

a bypass for part of said pumped water extending from said downstream portion to said upstream portion;

means in series with said heat exchanger for providing and maintaining a constant liquid flow through said heat exchanger; and means for connecting said heat exchanger and said means for providing and maintaining a constant liquid flow in series in said bypass for heating of said part of the pumped water with said cylindrical radiant surface burner at said constant liquid flow.

25. A water heater as claimed in claim 24, wherein:

said path extends from a pool of water back to a different portion of said pool of water whereby said water heater elevates the temperature of said pool of water.

26. Apparatus for changing the temperature in a mass of liquid, comprising in combination:

a path for said liquid having an upstream portion connected to said mass and a downstream portion connected to said mass at a distance from said upstream portion;

means in said path between said upstream and downstream portions for circulating said mass of liquid by pumping the liquid in said path;

a bypass for part of said pumped liquid extending from said downstream portion to said upstream portion of said path;

means in said by pass for providing and maintaining a constant liquid flow for said part of the pumped liquid in said by pass during said pumping;

means in said bypass for changing the temperature of said part of the pumped liquid at said constant liquid flow in said bypass;

means at said upstream portion for mixing said part of the pumped liquid of changed temperature with liquid pumped in said path whereby to change the temperature in said mass of liquid;

wherein said means for changing the temperature of said part of the pumped liquid include a gas-fired heater comprising in combination:

means for providing a combustible mixture of gas and air at an outlet thereof;

a cylindrical radiant surface burner having an inlet extending along a longitudinal axis of said cylindrical burner and being connected to said outlet for receiving said combustible mixture of gas and air, and having on said longitudinal axis an end opposite to said inlet;

means in said bypass for conducting liquid to be heated past said burner having a liquid inlet connected to said downstream portion and a liquid outlet connected to said upstream portion, said means for conducting liquid including a heat exchanger encompassing said cylindrical radiant surface burner in the form of a cylindrical structure having first passages for passing combustion gases substantially radially of said cylindrical radiant surface burner and said heat exchanger;

a housing enclosing said cylindrical radiant surface burner and said cylindrical structure of said heat exchanger and having a plurality of spaced corners projecting radially away from said cylindrical structure and defining second passages for combustion gases extending along said heat exchanger substantially in series to said first passages;

means for igniting said combustible mixture in said housing;

a refractory end piece in said housing adjacent said end of the cylindrical radiant surface burner;

a plurality of exhaust apertures defined by said refractory end piece and said plurality of corners; and means connected to said exhaust apertures for exhausting combustion gases from said cylindrical radiant surface burner through said first and second passages into and along said corners and into and through said exhaust apertures to the outside of said housing.

27. Apparatus as claimed in claim 26, wherein:

said housing is a parallelepipedal housing; and said corners are formed at right angles to sides of said parallelepipedal housing and extend from said one end to said opposite end.

28. Apparatus as claimed in claim 27, wherein:

said parallelepipedal housing is the only enclosure of said cylindrical radiant surface burner and said heat exchanger.

29. Apparatus as claimed in claim 28, wherein:

said parallelepipedal housing has an end plate at one end supporting said means for providing a combustible mixture of gas and air; and said means for exhausting combustion gases include a combustion gas exhaust fan at said opposite end of the housing.

30. Apparatus for changing the temperature in a mass of liquid, comprising in combination:

a path for said liquid having an upstream portion connected to said mass and a downstream portion connected to said mass at a distance from said upstream portion;

means in said path between said upstream and downstream portions for circulating said mass of liquid by pumping the liquid in said path;

a bypass for part of said pumped liquid extending from said downstream portion to said upstream portion of said path;

means in said bypass for providing and maintaining a constant liquid flow for said part of the pumped liquid in said bypass during said pumping;

means in said bypass for changing the temperature of said part of the pumped liquid at said constant liquid flow in said bypass, including a gas fired water heater concealed in a skirt of a spa containing said mass of liquid, and comprising in combination;

means for providing a combustible mixture of gas and air at an outlet thereof;

a cylindrical radiant surface burner having an axial inlet connected to said outlet for receiving said combustible mixture of gas and air, and having an end axially opposite to said inlet;

means in said bypass for conducting liquid to be heated past said burner having a liquid inlet connected to said downstream portion and a liquid outlet connected to said upstream portion, and including a heat exchanger encompassing said cylindrical radiant surface burner in a cylindrical structure having first passages for passing combustion gases substantially radially of said cylindrical radiant surface burner and said heat exchanger;

a parallelepipedal housing enclosing said cylindrical radiant surface burner and said cylindrical structure of said heat exchanger and having a plurality of spaced corners formed at right angles to sides of said housing and projecting radially away from said cylindrical structure, said parallelepipedal housing being the only enclosure of said cylindrical radiant surface burner and said heat exchanger, and having an end plate at one end for supporting said means for providing a combustible mixture of gas and air;

means for providing through said corners second passage for combustion gases extending along said heat exchanger substantially in series to said first passages;

means for igniting said combustible mixture in said housing;

a refractory end piece in said housing adjacent said end of the cylindrical radiant surface burner;

a plurality of exhaust apertures defined by said refractory end piece and said plurality of corners; and means connected to said exhaust apertures and including a combustion gas exhaust fan at an opposite end of said housing for exhausting combustion gases from said cylindrical radiant surface burner through said first and second passages into and along said corners and into and through said exhaust apertures to the outside of said housing;

said apparatus including means at said upstream portion for mixing said part of the pump liquid of changed temperature with liquid pump in said path whereby to change the temperature in said mass of liquid.

31. A method of heating water, comprising in combination the steps of:

providing a combustible mixture of gas and air at one end of said housing;

feeding said combustible mixture of gas and air from said one end of a housing to an inlet of a cylindrical radiant surface burner having an end opposite to said inlet in said housing;

conducting water to be heated past said burner through a heat exchanger encompassing said cylindrical radiant surface burner in the form of a cylindrical structure having first passages for passing combustion gases substantially radially of said cylindrical radiant surface burner and said heat exchanger;

providing a parallelepipedal housing enclosing said cylindrical radiant surface burner and said cylindrical structure of said heat exchanger providing said parallelepipedal housing with a plurality of spaced corners projecting radially away from said cylindrical structure, shaping said corners at right angles to sides of said parallelepipedal housing and extending said corners from said one end to said opposite ends to provide second passages for combustion gases extending along said heat exchanger substantially in series to said first passages;

providing means for igniting said combustible mixture in said housing;

providing a refractory end piece in said housing adjacent said end of the cylindrical radiant surface burner;

defining a plurality of exhaust apertures with said refractory end piece and said plurality of corners; and exhausting combustion gases from said cylindrical radiant surface burner at an end of said housing opposite to said one end of the housing through said first and second passages into and along said corners and into and through said exhaust apertures to the outside of said housing.

32. A method as claimed in claim 31, wherein:

said combustible mixture of gas and air is provided by drawing air for said mixture of gas and air at said one end of the housing only by exhausting combustion gases at said opposite end of the housing.

33. A method as claimed in claim 31, including the steps of:

providing an orifice structure at said one end of the housing for mixing gas and air; and drawing gas and air through said orifice structure at said one end of the housing only by exhausting combustion gases at said opposite end of the housing.

34. A method as claimed in claim 33, including the step of:

providing an orifice structure for inducing turbulence in mixing said gas and air.

35. A method as claimed in claim 31, including the step of:

admitting dilution air to the inside of said housing.

36. A method as claimed in claim 31, including the step of:

providing said parallelepipedal housing as the only enclosure of said cylindrical radiant surface burner and said heat exchanger.

37. A method as claimed in claim 36, including the steps of:

providing an orifice structure for mixing said gas and air; and drawing gas and air through said orifice structure only by said exhausting of combustion gases.

38. A method as claimed in claim 37, including the step of:

sensing a pressure drop provided by said orifice structure.

39. A method as claimed in claim 32, including the step of:

admitting dilution air to the inside of said housing.

40. A method as claimed in claim 32, including the step of:

providing said parallelepipedal housing as the only enclosure of said cylindrical radiant surface burner and said heat exchanger.

41. A method as claimed in claim 31, including the steps of:

forming said refractory end piece inside of said corners to provide said exhaust apertures inside of and along each of said corners.

42. A method for changing the temperature in a mass of liquid, comprising in combination the steps of:

circulating said mass of liquid by pumping the liquid in a path extending from said mass of liquid back to said mass of liquid;

providing a bypass for part of said pumped liquid from a downstream portion of said path to an upstream portion of said path;

providing and maintaining a constant liquid flow for said part of the pumped liquid in said bypass during said pumping;

changing the temperature of said part of the pumped liquid at said constant liquid flow in said bypass;

changing the temperature in said mass by mixing at said upstream portion said part of the pumped liquid of changed temperature from said bypass with liquid pumped in said path;

wherein said changing of the temperature of said part of the pumped liquid includes the steps of:

providing a combustible mixture of gas and air;

feeding of said combustible mixture of gas and air to an inlet of a cylindrical radiant surface burner having end opposite to said inlet;

conducting liquid to be heated past said burner through a heat exchanger encompassing said cylindrical radiant surface burner in the form of a cylindrical structure having first passages for combustion gases therethrough substantially radially of said cylindrical radiant surface burner and said heat exchanger;

providing a parallelepipedal housing enclosing said cylindrical radiant surface burner and said cylindrical structure of said heat exchanger, providing said parallelepipedal housing with a plurality of spaced corners projecting radially away from said cylindrical structure, said corners defining second passages for combustion gases extending along said heat exchanger substantially in series to said first passages;

igniting said combustible mixture in said housing;

providing a refractory end piece in said housing adjacent said end of the cylindrical radiant surface burner;

defining a plurality of exhaust apertures with said refractory end piece and said plurality of corners; and exhausting combustion gases from said cylindrical radiant surface burner through said first and second passages into and along said corners and into and through said exhaust apertures to the outside of said housing.

43. A method as claimed in claim 42, including the step of:

shaping said corners as right angles to sides of said parallelepipedal housing.

44. A method as claimed in claim 43, including the step of:

providing said parallelepipedal housing as the only enclosure of said cylindrical radiant surface burner and said heat exchanger.

45. A method as claimed in claim 42, including the step of:

concealing said gas fired water heater in a skirt of a spa containing said mass of liquid.

* * * * *